US010736472B1

(12) United States Patent
Gardner

(10) Patent No.: US 10,736,472 B1
(45) Date of Patent: Aug. 11, 2020

(54) SOAP-FILLED DISPOSABLE AND REUSABLE BATH SPONGE AND METHOD OF MANUFACTURE

(71) Applicant: Helen Thomasina Gardner, Brooklyn, NY (US)

(72) Inventor: Helen Thomasina Gardner, Brooklyn, NY (US)

(73) Assignee: Helen Thomasina Gardner, Brooklyn, NY (US)

( * ) Notice: Subject to any disclaimer, the term of this patent is extended or adjusted under 35 U.S.C. 154(b) by 137 days.

(21) Appl. No.: 14/999,182

(22) Filed: Apr. 9, 2016

(51) Int. Cl.
*A47K 7/02* (2006.01)
*A47K 7/03* (2006.01)
*C11D 17/04* (2006.01)

(52) U.S. Cl.
CPC ..... *A47K 7/03* (2013.01); *A47K 7/028* (2013.01); *C11D 17/049* (2013.01)

(58) Field of Classification Search
CPC ..... A47K 7/03; A47L 13/17
USPC ..... 401/201
See application file for complete search history.

(56) References Cited

U.S. PATENT DOCUMENTS 1,386,041 A * 8/1921 Shaw ..... A47K 7/03 15/244.3
6,887,007 B2 * 5/2005 Sorrell ..... A47K 7/03 401/183
2013/0125324 A1 * 5/2013 Celia, Sr. ..... A47K 7/03 15/104.93

* cited by examiner

*Primary Examiner* — Jennifer C Chiang
(74) *Attorney, Agent, or Firm* — Helen Thomasina Gardner

(57) ABSTRACT

Invention is a lathering and body scrubbing cleansing device comprised of a silicone and mesh pod portion which contains at least one soap additive as well as the method of making the same. When wet, and with application of soft, squeezing type manual pressure by the user, the device will produce a frothy, abundant lather delivered through several mesh protrusions located on top of the pod. Inside the pod additional soap additive is housed and mesh tubing is secured and supported. On the outside, lower portion of the pod, a silicone handle allows end user to slide fingers through and palm device. The 2 pod halves are sealed together along perimeter creating a completed structure. Being lightweight, this body cleansing device can be comfortably and freely maneuvered over the skin's surface for an exhilarating cleansing experience.

7 Claims, 1 Drawing Sheet

SOAP-FILLED DISPOSABLE AND REUSABLE BATH SPONGE AND METHOD OF MANUFACTURE

BACKGROUND

My present invention combines two fundamental parts of body cleansing: Soap and a Cleaning Device. It makes life easier and is more convenient because whether at home or traveling, it is no longer necessary to deal with a separate cleanser and cleaning device. This all-in-one concept simplifies a daily routine. It also causes less clutter because there are no bottles or containers to contend with. The device is small and lightweight, thus causing less worries and problems when traveling.

SUMMARY

Invention is a unique silicone and mesh body cleansing device with soap additive. Skin goes through many challenges on a daily basis, so a thorough clean is a fundamental part of skin care. Silicone is inherently inert to bacteria, fungi, and mold. User wets the device, and applies gentle pressure in the form of squeezing. This pressure will activate the soap additive, which will then produce an abundance of wonderfully fragrant, or unscented lather, which will be delivered through the perforated pod top through the outer, mesh covered, cubic sponges, and from the additional soap additive which resides inside the pod base. Only natural oils and wholesome ingredients are used in the soap additive. Once the skin cleansing experience has been completed, user can give device an additional squeeze to remove any excess water and then hang device by silicone handle to dry until the next exhilarating experience.

DETAILED DESCRIPTION OF DRAWINGS

Figure 1:
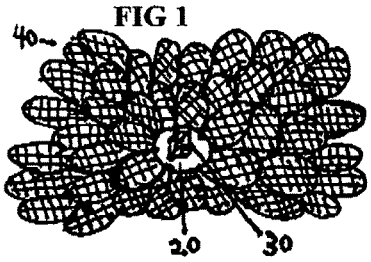
FIG. 1 is a top view of the unique cleansing sponge of the invention.

FIG. 1 is a general depiction of the unique bathing and cleansing device of the invention. Element 30 shows general depiction.

Figure 2:
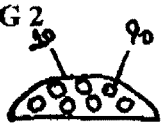
FIG. 2 is a view of perforated silicone pod top portion.

FIG. 2 is a general exploded view showing the elements from which the bathing and cleansing device of FIG. 1 is manufactured, Element 10 is the perforated pod top.

Figure 3:
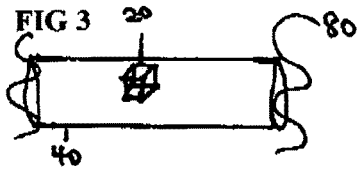
FIG. 3 is a view of the soap-saturated cubic sponge encased in tubular mesh.

FIG. 3 is a view of how cubic sponge 20, encased in mesh netting 40 is inserted into top portion of silicone pod 10 through the plurality of perforations 90 in pod top, plastic thread 80 connects both ends of the tubular mesh 40 together to secure mesh to top of pod.

Figure 4:
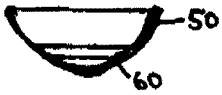
FIG. 4 is a view of the silicone pod bottom portion with soap additive nestled inside of pod bottom.

FIG. 4 depicts the additional soap additive 60 nestled into non-perforated pod bottom.

Figure 5:
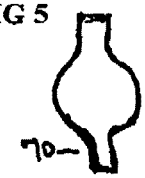
FIG. 5 is a view of the silicone handle which attaches to outer pod bottom.

FIG. 5 depicts the silicone handle 70 which attaches to outer portion of pod bottom 50.

Figure 6:
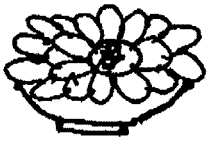
FIG. 6 is a view of the completely assembled body cleansing device.

FIG. 6 is a depiction of the fully assembled unique body cleansing device.

The invention claimed is:

1. A bathing or cleaning device comprising: a pliable, pod-shaped housing with a hollow cavity made of silicone and configured to be held in one hand of a user; said housing comprises an upper half portion and a lower half portion; a plurality of round perforations strategically dispersed along said upper half portion; a plurality of cubic-shaped sponges saturated with soap additive and encased in mesh tubing with closed ends protrude from said hollow cavity and out of a selective set of said plurality of round perforations, while keeping neighboring perforations free of sponges for water to flow through; said lower half portion filled with additional soap additive and sealed to said upper half portion to provide an abundance of lather from said device when submerged in water and squeezed during use.

2. The bathing or cleaning device of claim 1 can contain soap that is scented or unscented.

3. The bathing or cleaning device of claim 1 can contain soap of any shape and consistency.

4. The bathing or cleaning device of claim 1 further including a silicone strap handle attached at the middle of one side of the shaped silicone pod structure by using appropriate tool.

5. The bathing or cleaning device of claim 1 wherein said housing pod of device is made of medical grade silicone.

6. The bathing or cleaning device of claim 1 wherein said handle is attached to outer portion of base or lower pod by utilizing appropriate heating apparatus.

7. The bathing or cleaning device of claim 1 further including additional soap additive place inside bottom portion of pod.

* * * * *